United States Patent [19]

Gram

[11] 4,344,377

[45] Aug. 17, 1982

[54] SAIL CRAFT

[76] Inventor: Knud F. Gram, Tibberup Alle 28, Espergaerde 3060, Denmark

[21] Appl. No.: 190,868

[22] PCT Filed: May 14, 1979

[86] PCT No.: PCT/DK79/00014

§ 371 Date: Jan. 16, 1980

§ 102(e) Date: Jan. 11, 1980

[87] PCT Pub. No.: WO79/01077

PCT Pub. Date: Dec. 13, 1979

[30] Foreign Application Priority Data

May 16, 1978 [DK] Denmark ..... 2134/78

[51] Int. Cl.[3] ..... B63H 9/04; B63B 15/00

[52] U.S. Cl. ..... 114/103; 114/39

[58] Field of Search ..... 114/123, 39, 103

[56] References Cited

U.S. PATENT DOCUMENTS

| | | | |
|---|---|---|---|
| 3,016,860 | 1/1962 | Johnson | 114/39 |
| 3,391,668 | 7/1968 | Birchill | 114/103 |
| 3,395,664 | 8/1968 | Greenberg et al. | 114/39 |
| 4,223,621 | 9/1980 | Berger | 114/39 |

FOREIGN PATENT DOCUMENTS

| | | | |
|---|---|---|---|
| 1921682 | 11/1970 | Fed. Rep. of Germany . | |
| 2658772 | 7/1978 | Fed. Rep. of Germany | 114/103 |
| 2755991 | 6/1979 | Fed. Rep. of Germany | 114/103 |
| 603392 | 8/1978 | Switzerland . | |
| 475918 | 2/1974 | United Kingdom . | |

*Primary Examiner*—Trygve M. Blix
*Assistant Examiner*—C. T. Bartz
*Attorney, Agent, or Firm*—Knobbe, Martens, Olson, Hubbard & Bear

[57] ABSTRACT

A device for increasing the motive force of a sail acting on a sail craft and at the same time decrease the risk of having the craft turned bottom up after a capsizing are obtained by fastening to the uppermost portion of the sail (3) a certain amount of flexible buoyancy foam (8) which is shaped such as to form together with the mast (1) and the sail (3) an efficient airfoil profile having a smooth contour. On account of its thickness, this airfoil profile will further counteract the short circuit flow of air from the pressure side to the suction side of the sail. The buoyancy foam (8) has at the same time a volume which is large enough to keep the sail (3) and the mast (1) floating at the water surface after a capsizing of the craft. In order to make the folding of the sail (3) easier prior to putting it into a sail bag, the buoyancy foam may be split up into a plurality of buoyancy zones separated by folding zones.

5 Claims, 2 Drawing Figures

SAIL CRAFT

FIELD OF THE INVENTION

The invention relates to a sail craft having a buoyancy body fastened to at least the upper portion of at least one of its sails.

BACKGROUND OF THE INVENTION

From U.S. Pat. No. 3,016,860 a sail boat is known, which has at the uppermost portion of the main sail an inflatable air bag which is inflated automatically like a balloon, when the boat capsizes. However, this air bag will produce a large air resistance when inflated and therefore cannot be used during normal sailing.

From Swiss patent specification No. 603 392 a windsurfer is known, by which the sail is provided with a buoyancy body consisting of a bag containing buoyancy material and being adapted to be folded around the uppermost portion of the mast and buttoned on to the sail, e.g. by means of press fasteners. A device of this kind cannot be used by sailing dinghies and keel boats, the sails of which are hoisted and lowered by means of a halyard. In addition, the mast, the buoyancy body and the sail form together a clumsy profile having a large "drag" and a small "lift".

SUMMARY OF THE INVENTION

It is the object of the invention to improve the buoyancy body in such way that it will permit hoisting and lowering of the sail in the usual way by means of a halyard, will produce an aerodynamically advantageous shape of the mast, the buoyancy body and the sail, taken in combination, and will also produce an "end plate effect", which will appreciably reduce the short circuit flow of air from the pressure side to the suction side of the sail across the upper portion of the sail, whereby, in addition, a much better aerodynamical efficiency of the main portion of the sail below the buoyancy body is obtained.

This is according to the invention obtained by the fact that the buoyancy body is made up of flexible foam material being attached to both sides of a single layer sail but having no connection with the mast, the foam material being shaped such as to form together with the sail and the mast an airfoil profile being as efficient as possible.

As the foam material has no connection whatsoever with the mast, but is attached to the sail only, it will be possible to hoist and lower the sail in the usual way by means of a halyard, and because the foam material is shaped in the said manner, the mast, the foam material and the sail will together form an effective airfoil profile having a rather large lift and a small drag. The front portion of the foam material will have a relatively large thickness, as its surface has to be flush with the surface of the mast in order to form the said airfoil profile, so that the foam material will have a comparatively broad, downward turned surface acting as an effective end plate at the upper portion of the sail. Thereby, the main portion of the sail below the foam material will acquire a greatly improved aerodynamical efficiency, because the ratio lift/drag will increase considerably on account of the end plate, as is known per se. These improvements in combination will result in an appreciable increase of the motive power produced by the sail. Measurements have indicated an increase of up to 85%.

At the same time the sail craft has been safeguarded against 180°—capsizings by means of the buoyancy force acting on the buoyancy body, when this is partially submerged after a capsizing.

In order to obtain an advantageous thickness ratio of the airfoil profile (in the range from 6–12%), the buoyancy material may be shaped such as to fill up the two outwardly open spaces between the mast and the two sides of the sail and to stretch right from the mast to the aft edge of the sail.

A larger flexibility of the buoyancy body, so that this may be cambered by the force of the wind, can be obtained, if the foam material is made up of a number of thin, flexible plastic foam sheets being laid flat on top of each other.

In order to make a folding of the buoyancy body possible, when the sail is put into a sail bag, the buoyancy material may be split up into horisontal sections preferably extending right from the mast to the aft edge of the sail and being separated from each other by folding zones.

DESCRIPTION OF THE PREFERRED EMBODIMENTS

Figure 1:
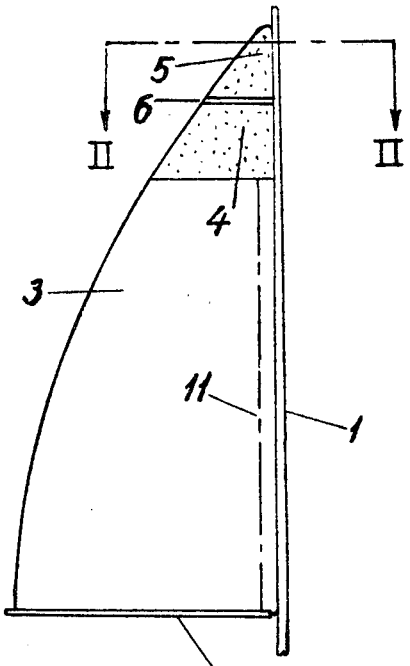

The invention will be described further in the following with reference to the drawing, in which FIG. 1 is a side view of a conventional Bermuda sail, the uppermost portion of which is provided with buoyancy material according to the invention, and FIG. 2 on a much larger scale is a section along the line II—II in FIG. 1.

The sail 3 shown in FIG. 1 consists of a single layer and is in a conventional manner along the forward edge and lower edge provided with a rope which can be inserted into grooves in a mast 1 and a boom 2, respectively. The uppermost portion of the sail 3 is split up into two buoyancy zones 4 and 5 being separated by a narrow folding zone 6.

Figure 2:
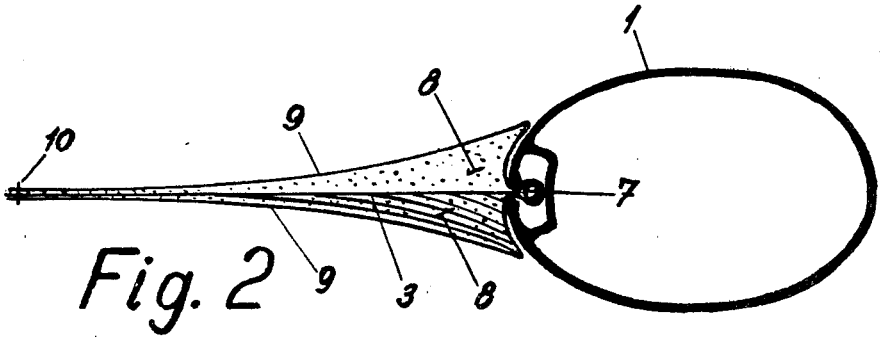

As shown in FIG. 2, the foreleech 7 of the sail is received in a groove along the aft edge of the mast 1 which consists of a profile obtainable on the market. At both sides of the sail 3 is fastened buoyancy material 8 consisting of for example flexible foam plastic which may be foamed up in a mold so that it shall not subsequently be cut to shape. A piece of sail cloth 9 is laid tightly around the foreleech 7, the two layers of the cloth being sewed together closely aft of the foreleech 7. To the rear of this seam, the two layers of sail cloth 9 extend along the outer surfaces of the buoyancy material 8 at both sides of the sail 3, and the two free edges of the sail cloth 9 are sewed on to the sail 3 by a seam 10 along the aft edge of the sail. However, the sail cloth 9 may be dispensed with, if the "skin side" of the buoyancy material 8 is faced outwardly and is in itself satisfactorily smooth and even.

It will be seen that the buoyancy material 8 is shaped such as to form together with the mast 1 and the sail 3 an aerodynamically advantageous profile having a much better lift/drag ratio than the profiled formed by the mast 1 and the sail 3 in combination. The thickness ratio of the profile of section II—II is about 0,25, but further down the thickness ratio will be appreciably smaller. Furthermore, the buoyancy material 8 has a volume which is large enough to keep the sail 3 and the mast 1 afloat in the water surface after a capsizing of the sail craft on which the mast 1 and the sail 3 is mounted.

Instead of foaming up the buoyancy material 8 in the top half a mould as shown in FIG. 2, it is possible to use a plurality of thin layers of material being laid flat on top of each other and cut to shape to produce the desired shape as shown in the bottom half of FIG. 2.

It is further possible to attach additional buoyancy material along the whole length of the forward edge of the sail 3, stretching for example from the mast 1 to the chain-dotted line 11 in FIG. 1. In this way an appreciable decrease of the drag of the sail and a small increase of the lift is obtained. Taken in combination this gives rise to a considerably larger motive force acting on the sail craft. However, for reasons of safety there is no need for this buoyancy material, as the buoyancy zones 4 and 5 are sufficient.

If buoyancy material is placed along the whole length of the forward edge of the sail, the mast profile should be adapted hereto. The profile may for instance consist of the front portion of a NACA 0012 bounded at the rear by a plane surface at right angles to the axis of symmetri of the profile. Hereby a still larger motive force of the sail can be obtained than in the case of the profile shown in FIG. 2.

The sail shown in FIGS. 1 and 2 can be used for any sail craft, i.e. also for keel boats, whereby the motive force per square meter of sail area will be increased by up to 85%, mainly due to the reduction of the short circuit flow of air from the pressure side to the suction side of the sail main portion situated below the thickened buoyancy zones 4 and 5.

I claim:

1. A sail craft having a mast and a thin flat sail attached thereto, a buoyancy body fastened to as least the upper portion of said sail, the buoyancy body being made of flexible foam material attached to both sides of the sail with the foam material being flush with the mast but having no connection with the mast, the foam material being shaped such as to form together with the sail and the mast an air foil profile having a smooth uninterrupted surface, with the foam material tapering from the mast towards the aft end of the sail.

2. The sail craft as claimed in claim 1 having the foam material made up of a number of vertically oriented, thin, flexible plastic foam sheets being laid flat against each other.

3. The sail craft as claimed in claim 1 having the buoyancy material split up into horizontal sections preferably extending from the mast to the aft edge of the sail and being separated from each other by a folding zone.

4. The sail craft as claimed in claim 1 wherein said foam material is formed on its lower edge to present a downwardly facing surface being substantially horizontal and at right angles to the sail surface, which acts as an end plate at the upper portion of the sail to appreciably reduce the flow of air from the pressure side to the suction side of the sail and thereby improve the aerodynamic effectiveness of the main portion of the sail below the buoyancy body.

5. The sail craft as claimed in claim 1 including additional buoyancy material along the forward end of the sail below said buoyancy body, said additional buoyancy material conforming to the profile of the rear of said mast and tapering towards the sail to form a smooth uninterrupted profile on each side of the sail.

* * * * *